US006059327A

United States Patent [19]

Yoshikuwa

[11] Patent Number: 6,059,327

[45] Date of Patent: May 9, 2000

[54] LATCH SYSTEM FOR A TRUNK LID OF AN AUTOMOBILE

[75] Inventor: Masakatsu Yoshikuwa, Yamanashi-ken, Japan

[73] Assignee: Mitsui Kinzoku Kogyo Kabushiki Kaisha, Tokyo, Japan

[21] Appl. No.: 09/112,454

[22] Filed: Jul. 9, 1998

[30] Foreign Application Priority Data

Jul. 10, 1997 [JP] Japan ..... 9-200761

[51] Int. Cl.[7] ..... E05C 3/06

[52] U.S. Cl. ..... 292/216; 292/DIG. 43; 70/264; 70/256

[58] Field of Search ..... 292/216, 201, 292/DIG. 42, DIG. 43, DIG. 23, DIG. 24; 70/264, 256, 257, 278.7

[56] References Cited

U.S. PATENT DOCUMENTS

| | | | |
|---|---|---|---|
| 4,805,427 | 2/1989 | Bates et al. | 70/264 |
| 4,962,955 | 10/1990 | Ferrara et al. | 292/216 |
| 4,969,672 | 11/1990 | Childs et al. | 292/201 |
| 4,979,384 | 12/1990 | Malesko et al. | 70/241 |
| 5,054,826 | 10/1991 | Dow et al. | 292/125 |
| 5,429,400 | 7/1995 | Kawaguchi et al. | 292/201 |
| 5,498,040 | 3/1996 | Silye | 292/201 |
| 5,511,838 | 4/1996 | Baughman et al. | 292/201 |
| 5,632,515 | 5/1997 | Dowling | 292/216 |
| 5,642,636 | 7/1997 | Mitsui | 70/237 |
| 5,829,799 | 11/1998 | Yamagishi et al. | 292/201 |
| 5,868,444 | 2/1999 | Brackmann et al. | 292/201 |
| 5,909,918 | 6/1999 | Kowalewski et al. | 292/199 |

*Primary Examiner*—B. Dayoan
*Assistant Examiner*—Clifford B. Vaterlaus
*Attorney, Agent, or Firm*—Browdy and Neimark

[57] ABSTRACT

A latch system for a trunk lid of an automobile comprises a latch, a ratchet, a key lever for releasing the ratchet from the latch, a key cylinder connected to the key lever and having a locked position, a neutral position, an open position and an unlocked position, a trunk opener or a motorized actuator, an open lever operated by the trunk opener or motorized actuator, a locking mechanism displaced between unlocked and locked states. The ratchet lever is released from the latch when the key cylinder is shifted to the open position. The locking mechanism is displaced into the locked state when the key cylinder is shifted to the locked position, and the locked state is continuously kept until the key cylinder is shifted to the unlocked position. The open position of the key cylinder is set between the neutral position and the unlocked position. The neutral position of the key cylinder is set between the open position and the locked position.

6 Claims, 5 Drawing Sheets

LATCH SYSTEM FOR A TRUNK LID OF AN AUTOMOBILE

BACKGROUND OF THE INVENTION

1. Field of the Invention

The present invention relates to a latch system for a trunk lid of an automobile.

2. Description of the Related Art

A conventional latch system for a trunk lid of an automobile may be released, without using a key, by means of an operation of a trunk opener provided in the vicinity of a driver's seat so as to open the trunk lid. Therefore, if a passenger door is illegally opened when important documents and/or valuable articles are kept in an automotive trunk room, the documents or valuables may be easily stolen by opening the trunk lid using the opener.

In order to prevent the above disadvantage, there has been proposed a latch system for a trunk lid which includes a locking mechanism which is displaceable by means of a change-over operation of the automotive key between an unlocked state for enabling an opening operation of the trunk opener and a locked state for disabling the opening operation of the opener. This latch system has a disadvantage in which the locking mechanism is simultaneously released when the trunk lid is opened. That is, the operation for opening the trunk lid by the key changes the locking mechanism into the unlocked state. Therefore, if the locked state is desired when closing the trunk lid, an additional operation for returning the locking mechanism into the locked state should be necessary.

Further, in the case of lending an automobile to one's friend, there has been proposed another latch system for a trunk lid which includes a locking mechanism for preventing documents kept in the trunk room from being read by the friend. The locking mechanism is constructed in such a manner that a master key of the automobile is acceptable, and a sub-key is not acceptable. However, this latch system has the same problem as the aforesaid latch system.

SUMMARY OF THE INVENTION

Therefore, an object of the present invention is to provide a latch system which overcomes the aforesaid disadvantage.

Further, another object of the present invention is to provide a latch system which can open a trunk lid by using a key without changing a locking mechanism into an unlocked state.

DETAILED DESCRIPTION OF THE PREFERRED EMBODIMENT

Figure 1:
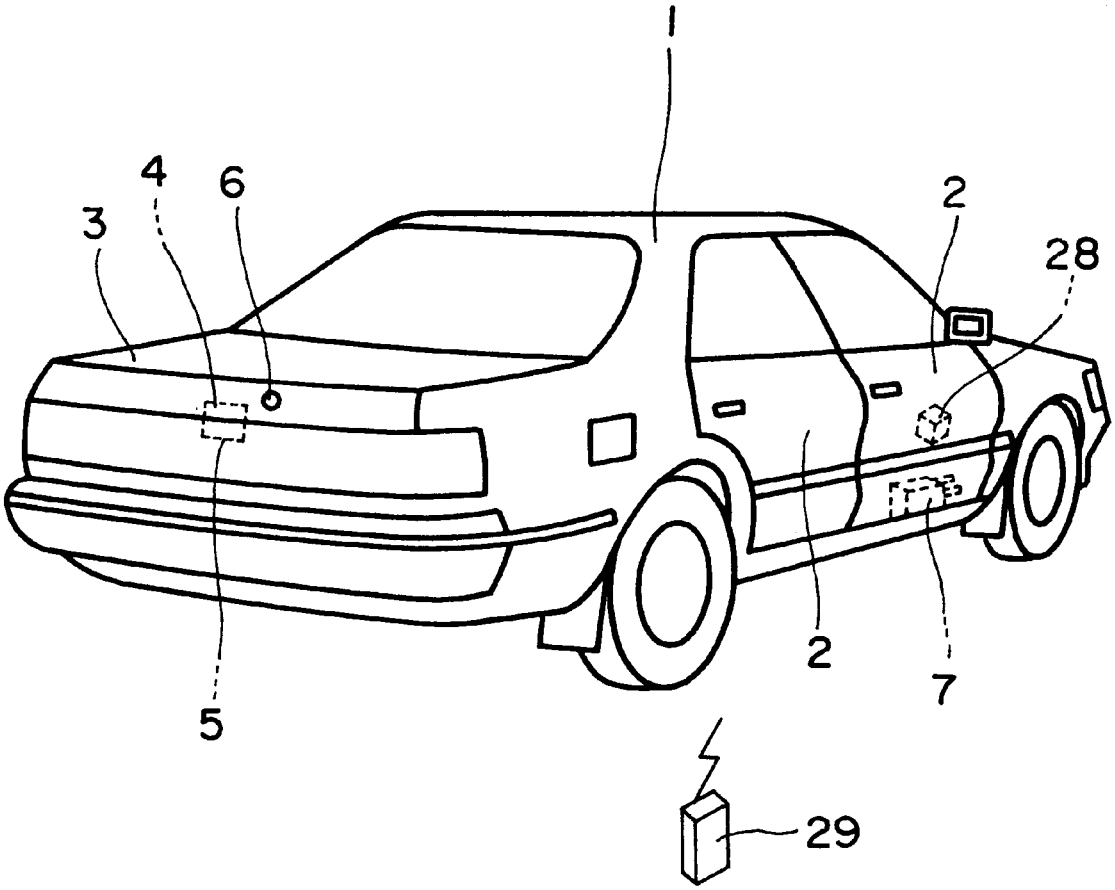
FIG. 1 is a perspective view showing an automobile which includes a trunk lid to which a latch system of the present invention is mounted.

FIG. 1 shows a whole appearance of an automobile which has a vehicle body 1, a plurality of passenger doors 2 and a trunk lid 3. A latch system 4 in accordance with the present invention is mounted to one of the trunk lid 3 or the vehicle body 1 in the vicinity of the trunk lid 3. The latch system 4 keeps the trunk lid 3 in a closed state in cooperation with a striker 5 which is mounted to the other of the trunk lid 3 or the vehicle body 1. As described later, the latch system 4 is released by operating a key cylinder 6, a trunk opener 7 arranged in a vicinity of a driver's seat or the like so as to open the trunk lid 3.

Figure 2:
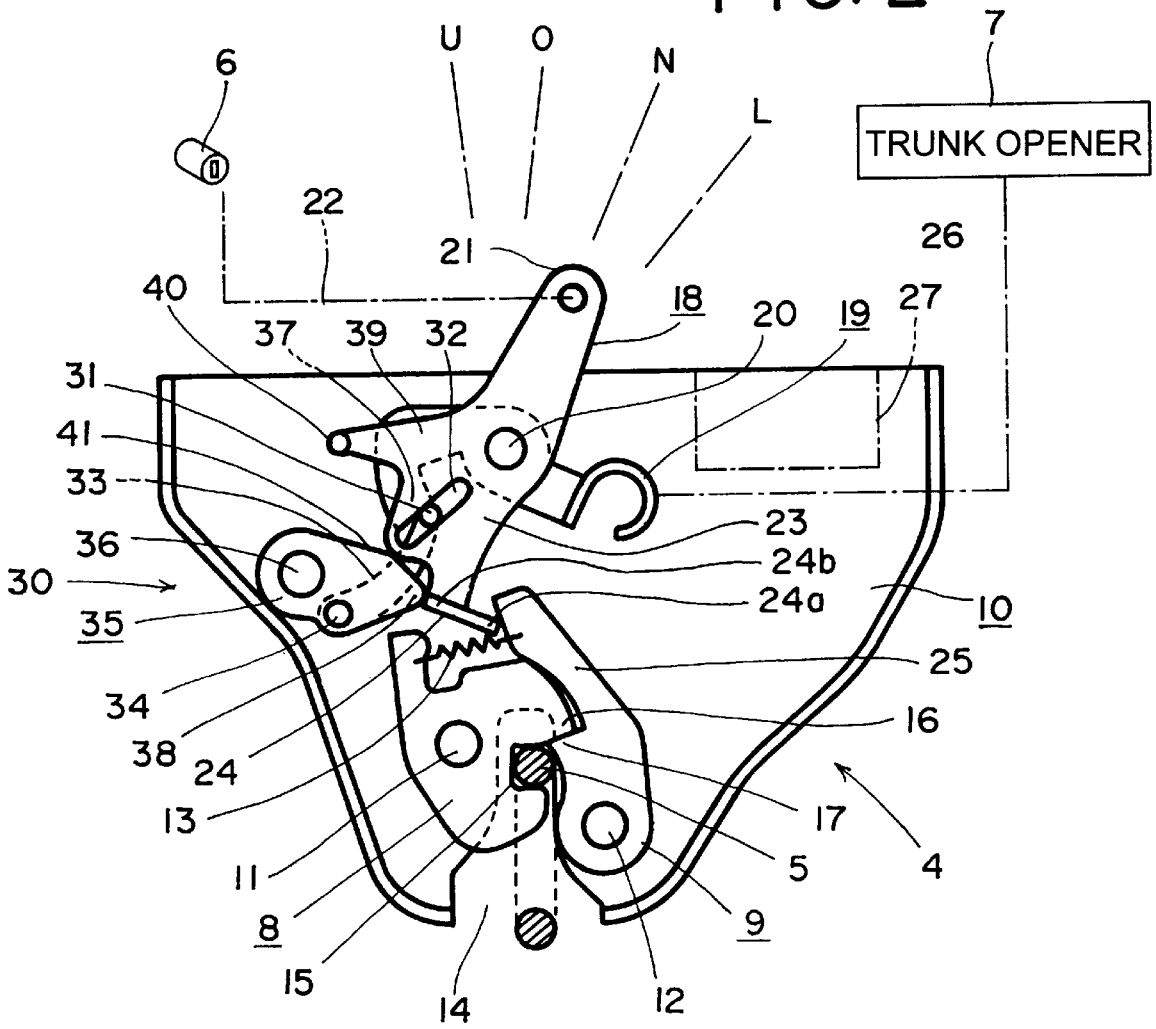
FIG. 2 is an enlarged front view showing the latch system in an unlocked state.

As shown in FIG. 2, the latch system 4 has a latch 8 which is engageable with the striker 5, and a ratchet 9 which keeps an engagement of the latch 8 with the striker 5 by engaging with the latch 8. The latch 8 and the ratchet 9 are rotatably mounted to a metallic base plate 10 fixed to the trunk lid 3 (or to the vehicle body 1) by means of a latch shaft 11 and a ratchet shaft 12, respectively. A spring 13 is interposed between the latch 8 and the ratchet 9 so that the latch 8 is urged in a clockwise direction and the ratchet 9 is urged in a counterclockwise direction. When the trunk lid 3 is moved toward a closed position from an open position, the striker 5 enters a passage 14 formed in the base plate 10, and is then fitted into a U-shaped groove 15 of the latch 8 so as to rotate the latch 8 counterclockwise against the force of the spring 13, and a pawl 17 of the ratchet 9 engages with a stepped portion 16 of the latch 8, thereby the trunk lid 3 is closed. FIG. 2 shows a closed state of the trunk lid 3.

The latch system 4 further includes a key lever 18 which is rotated by an operation or rotation of the key cylinder 6, and an open lever 19 which is rotated by an operation of the trunk opener 7. The key lever 18 and the open lever 19 are supported on an upper portion of the base plate 10 by means of a supporting shaft 20. A first arm 21 of the key lever 18 is connected to the key cylinder 6 through a rod 22, and a second arm 23 of the key lever 18 is formed with a bent portion 24 which extends parallel with an axis of the ratchet shaft 12. A rotating locus of the bent portion 24 overlaps with an elongation 25 of the ratchet 9.

Figure 11:
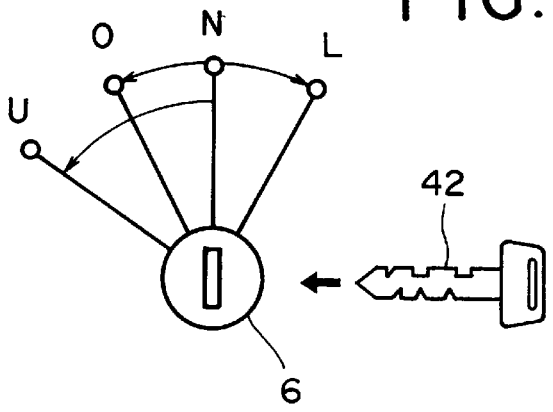
FIG. 11 is a view schematically showing a rotating range of a key cylinder of the latch system.

As shown in FIG. 11, the key cylinder 6 includes four positions, that is, a locked position L, a neutral position N, an open position O and an unlocked position U. When no operation by a key 42 is given to the key cylinder 6, the key cylinder 6 is kept at the neutral position N by an elastic force of a spring (not shown). The key lever 18 is cooperative with the key operation, and is shifted to the corresponding one of positions L, N, O and U shown in FIGS. 2–7 in accordance with the displacement of the key cylinder 6.

Figure 3:
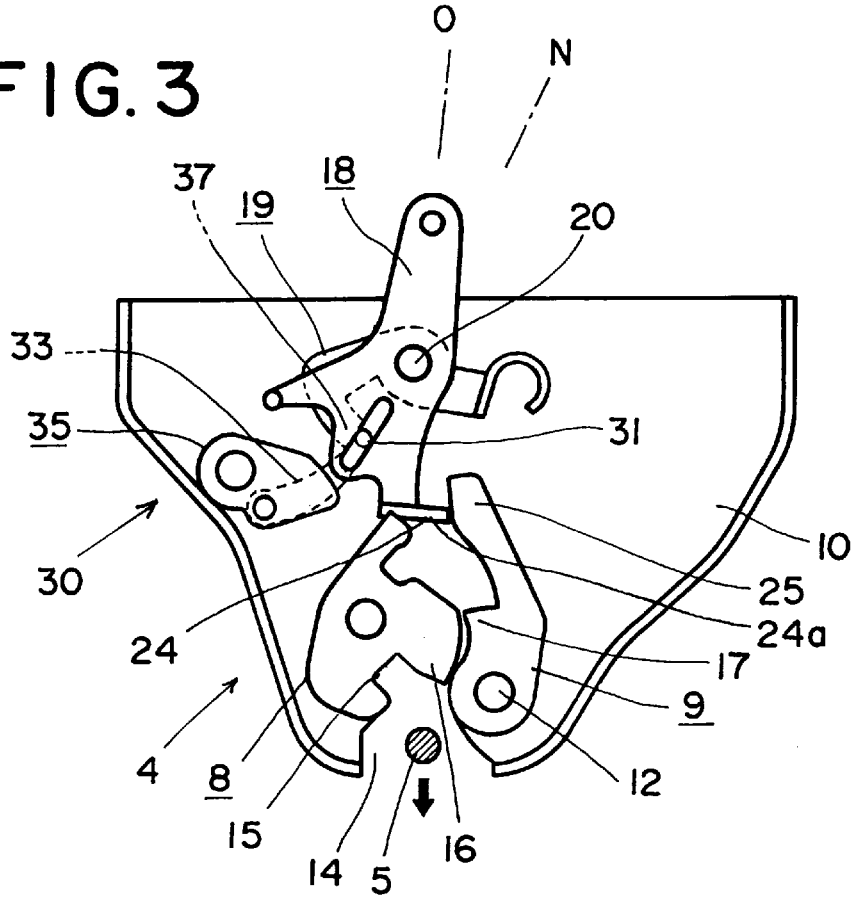
FIG. 3 is a front view showing a state that a key lever of the latch system of FIG. 2 is shifted to an open position.

When the key cylinder 6 rotates from the neutral position N to the open position O, the key lever 18 is, in FIG. 2, rotated counterclockwise and a front end 24*a* of the bent portion 24 is then abutted against the elongation 25 to rotate the ratchet 9 clockwise against the elastic force of the spring 13. Whereupon the latch 8 is made free, and the striker 5 is then released as shown in FIG. 3, thereby the trunk lid 3 is opened.

In general, the opener 7 and the open lever 19 are directly connected to each other by means of a wire cable 26. However, there may be the case where the latch system 4 has an actuator 27 with a motor or a solenoid for rotating the open lever 19 by electric power. In this case, an operation switch 28 for actuating the actuator 27 is provided in the vicinity of the driver's seat, in place of the opener 7. Further, it is possible to actuate the actuator 27 according to a signal from a well-known portable radio transmitter 29.

The key lever 18 is formed with a slot 32 into which a lock pin 31 of a locking mechanism 30 is slidably fitted. The lock pin 31 is formed at one end of a link 33 of the locking mechanism 30, and a pin 34 formed at the other end of the link 33 is connected to a lock lever 35 of the locking mechanism 30. The lock lever 35 is rotatably attached to the base plate 10 by means of a shaft 36. The lock pin 31 shown in FIG. 2 is in an unlocked position, and faces an abutting portion 37 formed in the open lever 19. Thus, when the open lever 19 is rotated counterclockwise by means of a manual power of the trunk opener 7 or an electric power of the actuator 27, the abutting portion 37 comes into contact with the lock pin 31 to rotate the key lever 18. Thereafter, as shown in FIG. 3, the ratchet 9 is separated from the latch 8, and the trunk lid 3 is then opened.

Figure 4:
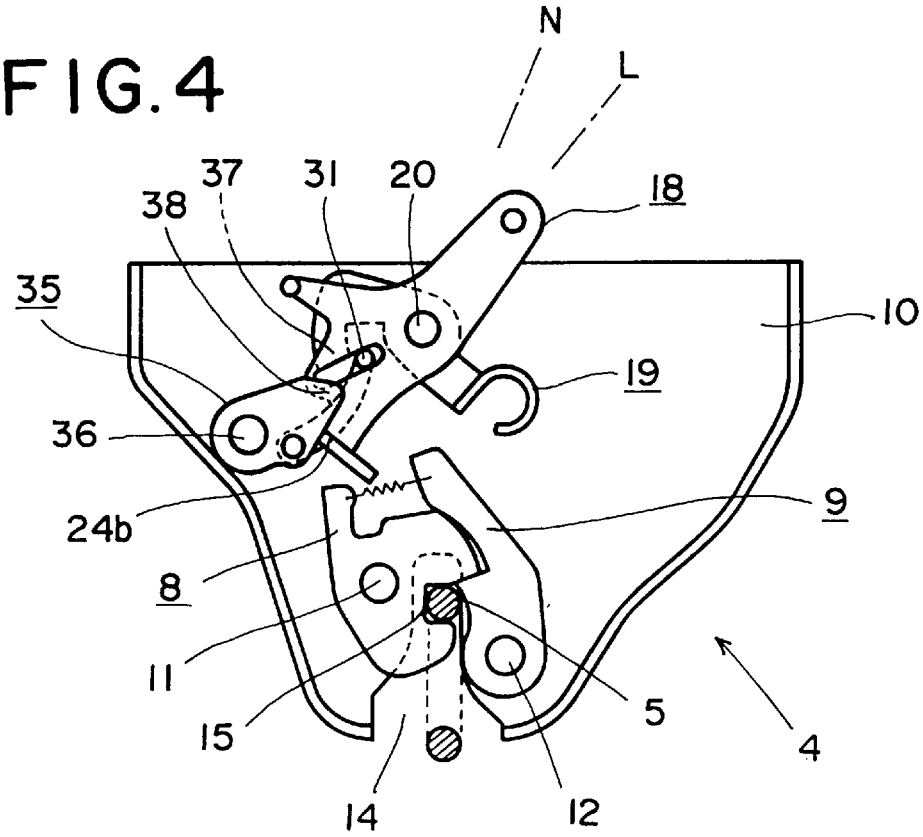
FIG. 4 is a front view showing a state that the key lever of the latch system of FIG. 2 is shifted to a locked position.
Figure 5:
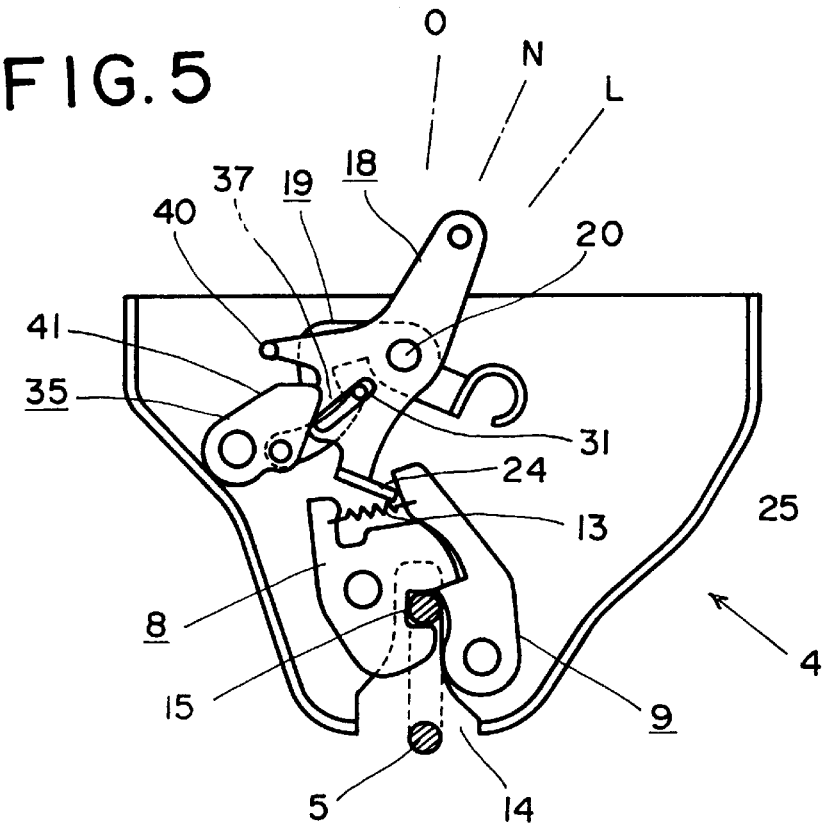
FIG. 5 is a front view showing a state that the key lever of the latch system of FIG. 4 is shifted to a neutral position.
Figure 6:
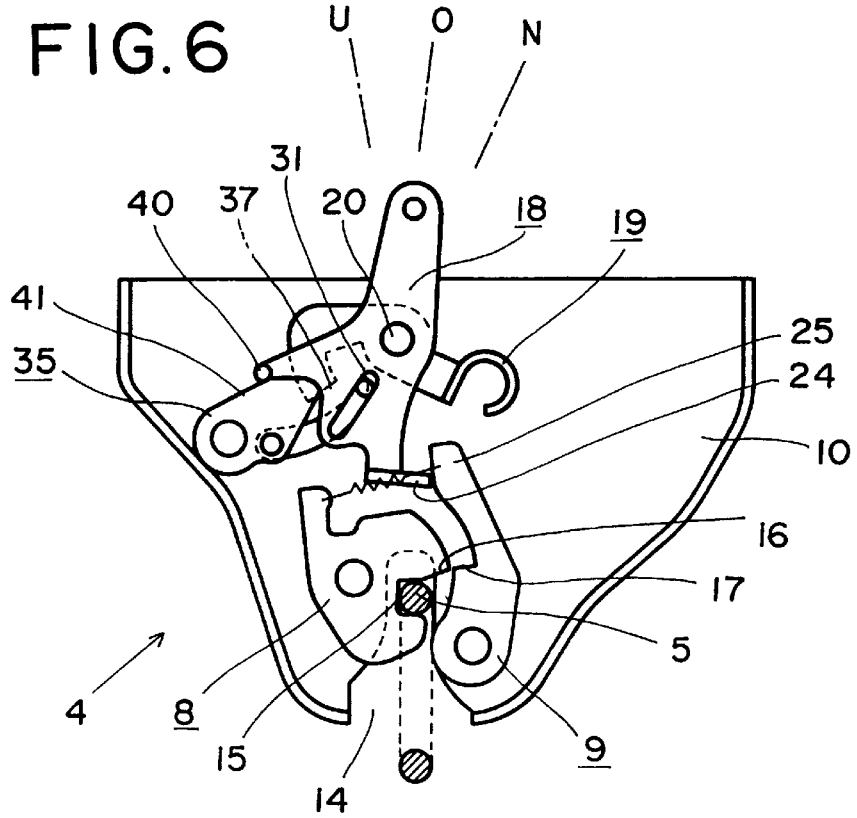
FIG. 6 is a front view showing a state that the key lever of the latch system of FIG. 5 is shifted to the open position.

When the lock pin 31 is in the unlocked position as shown in FIG. 2, a pointed tip 38 of the lock lever 35 is opposed to a rear end 24*b* of the bent portion 24 of the key lever 18 which is in the neutral position N. In this state, when the key lever 18 is shifted from the neutral position N to the locked position L by means of the key cylinder 6, the rear end 24*b* pushes the pointed tip 38 so as to rotate the lock lever 35 counterclockwise, and the lock pin 31 is then slid toward the supporting shaft 20 and separated from the abutting portion 37 of the open lever 19 so as to be shifted to a locked position as shown in FIG. 4. FIG. 5 shows a state that the key lever 18 of FIG. 4 is returned to the neutral position N from the lock position L.

As shown in FIG. 5, when the lock pin 31 is situated on the locked position, the abutting portion 37 of the open lever 19 is disengageable with the lock pin 31. Therefore, even if the open lever 19 is rotated in the counterclockwise direction by means of a manual power of the opener 7 or an electric power of the actuator 27, the key lever 18 cannot be rotated, and the trunk lid 3 is kept in the closed state.

A protrusion 40 is formed at the distal end of a third arm 39 of the key lever 18. As shown in FIG. 5, when the lock pin 31 is in the locked position and the key lever 18 is in the neutral position N, the protrusion 40 is separated by a predetermined distance from a side face 41 of the lock lever 35. And then, when rotating the key lever 18 from the state shown in FIG. 5 to the open position O, the protrusion 40 does not rotate the lock lever 35 although it contacts with the side face 41 of the lock lever 35. However, at this time the bent portion 24 of the key lever 18 abuts against the elongation 25 so as to rotate the ratchet 9. Thus, when the key lever 18 is rotated to the open position O, the trunk lid 3 can be opened without returning the lock pin 31 from the locked position to the unlocked position. In the case where the trunk lid 3 is opened in the manner as described above, the lock pin 31 is kept in the locked position, so that the locked state of the locking mechanism 30 can be continued only by closing the trunk lid 3.

Figure 7:
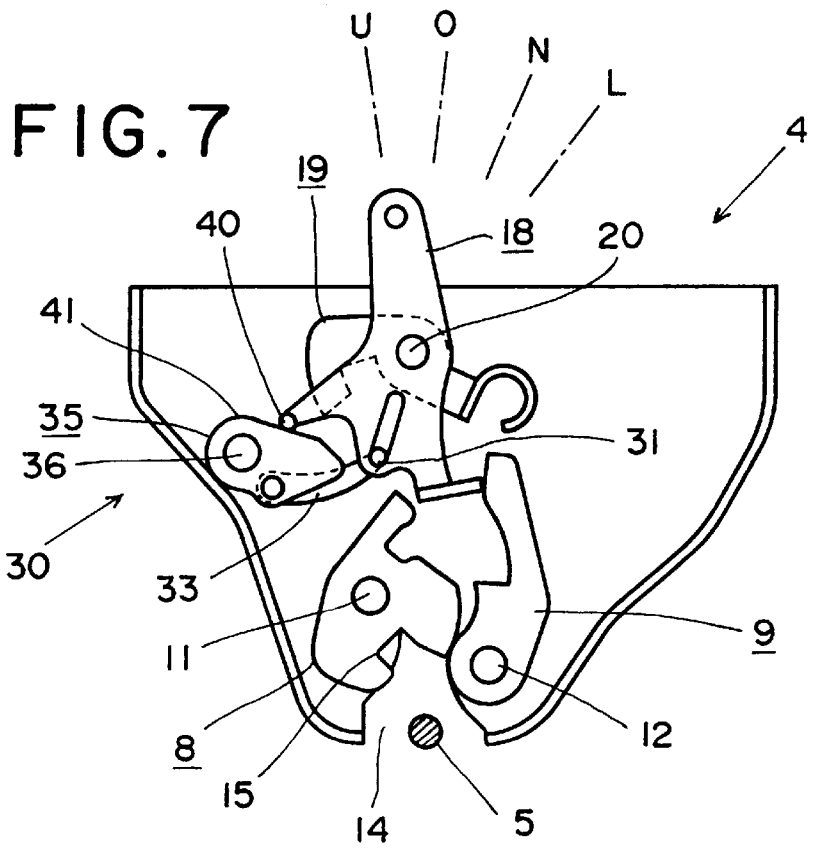
FIG. 7 is a front view showing a state that the key lever of the latch system of FIG. 6 is shifted to an unlocked position.
Figure 8:
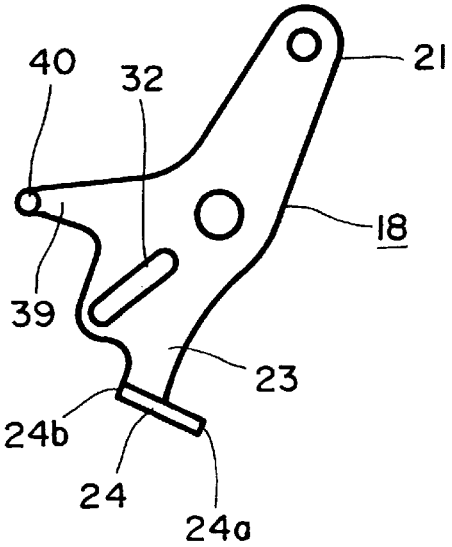
FIG. 8 is an enlarged front view showing the key lever.
Figure 9:
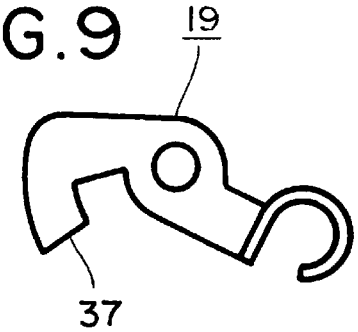
FIG. 9 is an enlarged front view showing an open lever of the latch system.
Figure 10:
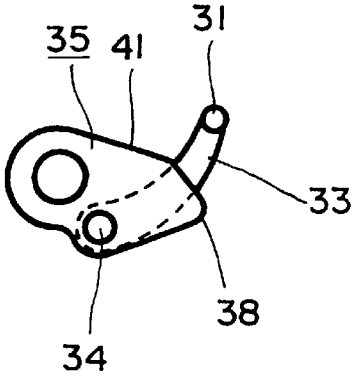
FIG. 10 is an enlarged front view showing a lock lever and a link of the latch system.

In the case of changing the locking mechanism 30 into the unlocked state when opening the trunk lid 3, the key cylinder 6 is rotated from the neutral position N to the unlocked position U beyond the open position O. That is, when the key lever 18 is shifted to the open position O due to the rotation of the key cylinder 6, as described above, the trunk lid 3 is opened (FIG. 6), and subsequently, when the key lever 18 is rotated to the unlocked position U, the protrusion 40 of the key lever 18 pushes the side face 41 of the lock lever 35 so as to rotate the lock lever 35 in the clockwise direction, and thus, the key lever 18 becomes a state as shown in FIG. 7. In this state, the lock pin 31 is shifted to the unlocked position by the rotation of the lock lever 35, so that the locking mechanism 30 can be returned to the unlocked state. In this manner, the trunk lid 3 and the locking mechanism 30 can be respectively opened and released at one-time operation.

The key cylinder 6 may be constructed in a manner that the master key is acceptable and the sub-key is not acceptable, like the conventional latch system.

What is claimed is:

1. A latch system for a trunk lid of an automobile, comprising:

a base plate adapted to be fixed to one of a vehicle body of the automobile or the trunk lid;

a striker adapted to be fixed to the other of the vehicle body and the trunk lid;

a latch rotatably mounted to the base plate and engageable with the striker for shutting the trunk lid;

a ratchet rotatably mounted to the base plate and engageable with the latch for holding an engagement between the latch and the striker;

a key lever movably mounted to the base plate for releasing the ratchet from the latch when moved;

a key cylinder connected to the key lever, said key cylinder having a locked position, a neutral position, an open position and an unlocked position;

an opener adapted to be provided in a vicinity of a driver's seat of the automobile;

an open lever movably mounted to the base plate and connected to the opener; and a locking mechanism provided on the base plate and displaced by a shift of the key cylinder between an unlocked state in which a movement of the open lever is transmitted to the key lever and a locked state in which the movement of the open lever is not transmitted to the key lever;

wherein said ratchet is released from said latch by a movement of said key lever in either the unlocked state or the locked state when said key cylinder is shifted to the open position from the neutral position;

wherein said locking mechanism is displaced into the locked state when the key cylinder is shifted to the locked position, and the locked state is continuously kept until the key cylinder is shifted to the unlocked position;

wherein said open position of the key cylinder is set between the neutral position and the unlocked position wherein rotation of said key cylinder up to the open position from the neutral position does not return the locking mechanism to the unlocked state from the locked state.

2. The latch system according to claim 1, wherein said neutral position of the key cylinder is set between the open position and the locked position.

3. A latch system for a trunk lid of an automobile, comprising:

a base plate adapted to be fixed to one of a vehicle body of the automobile or the trunk lid;

a striker adapted to be fixed to the other of the vehicle body and the trunk lid;

a latch rotatably mounted to the base plate and engageable with the striker for shutting the trunk lid;

a ratchet rotatably mounted to the base plate and engageable with the latch for holding an engagement between the latch and the striker;

a key lever movably mounted to the base plate for releasing the ratchet from the latch when moved;

a key cylinder connected to the key lever, said key cylinder having a locked position, a neutral position, an open position and an unlocked position;

an actuator having a motor or solenoid;

an open lever movably mounted to the base plate and moved by a power of the actuator; and a locking mechanism provided on the base plate and displaced by a shift of the key cylinder between an unlocked state in which a movement of the open lever is transmitted to the key lever and a locked state in which the movement of the open lever is not transmitted to the key lever;

wherein said ratchet is released from said latch by a movement of said key lever in either the unlocked state or the locked state when said key cylinder is shifted to the open position from the neutral position;

wherein said locking mechanism is displaced into the locked state when the key cylinder is shifted to the locked position, and the locked state is continuously kept until the key cylinder is shifted to the unlocked position;

wherein said open position of the key cylinder is set between the neutral position and the unlocked position wherein rotation of said key cylinder up to the open position from the neutral position does not return the locking mechanism to the unlocked state from the locked state.

4. The latch system according to claim 3, wherein said neutral position of the key cylinder is set between the open position and the locked position.

5. The latch system according to claim 1, wherein a sequence of positions of the key cylinder comprises the neutral position and the open position being intermediate the locked position and the unlocked position, whereby the key is operable to open the trunk without changing the locked state.

6. The latch system according to claim 3, wherein a sequence of positions of the key cylinder comprises the neutral position and the open position being intermediate the locked position and the unlocked position, whereby the key is operable to open the trunk without changing the locked state.

* * * * *